US010306991B2

(12) United States Patent
Behlen

(10) Patent No.: US 10,306,991 B2
(45) Date of Patent: Jun. 4, 2019

(54) TRAVEL LEG RESTRAINT

(71) Applicant: Matthew J. Behlen, Wauwatosa, WI (US)

(72) Inventor: Matthew J. Behlen, Wauwatosa, WI (US)

( * ) Notice: Subject to any disclaimer, the term of this patent is extended or adjusted under 35 U.S.C. 154(b) by 30 days.

(21) Appl. No.: 15/594,630

(22) Filed: May 14, 2017

(65) Prior Publication Data

US 2017/0325593 A1 Nov. 16, 2017

Related U.S. Application Data

(60) Provisional application No. 62/336,001, filed on May 13, 2016.

(51) Int. Cl.

| | |
|---|---|
| ***A47C 20/00*** | (2006.01) |
| ***A47C 16/00*** | (2006.01) |
| ***A47C 7/52*** | (2006.01) |

(52) U.S. Cl.

CPC ..... *A47C 7/52* (2013.01)

(58) Field of Classification Search

CPC ..... A47B 23/002; A47B 2230/0011; A47B 23/001; A61G 5/10; A61G 7/10638; A61G 7/1096; A61G 2200/34; A61G 5/1091; A61G 7/0755; A47C 20/021; A47C 7/503; A47C 7/52; A47C 7/546

USPC ..... 5/648; 297/466

See application file for complete search history.

(56) References Cited

U.S. PATENT DOCUMENTS

| | | | | | |
|---|---|---|---|---|---|
| 1,845,338 | A * | 2/1932 | Querna | A61H 1/00 | 128/882 |
| 4,192,546 | A * | 3/1980 | Smith | A61G 5/10 | 297/423.17 |
| 4,805,605 | A * | 2/1989 | Glassman | A61F 5/0193 | 128/882 |
| 5,716,334 | A * | 2/1998 | Wade | A61F 5/0585 | 128/882 |
| 6,154,905 | A * | 12/2000 | Frydman | A47C 20/021 | 128/845 |
| 6,564,407 | B1 * | 5/2003 | Luu | A47C 7/022 | 297/219.1 |
| 6,578,218 | B2 * | 6/2003 | Wassilefsky | A47C 20/021 | 5/630 |
| D523,679 | S * | 6/2006 | Illingworth | D6/601 | |
| 7,166,083 | B2 * | 1/2007 | Bledsoe | A61F 5/0116 | 602/23 |
| 7,627,911 | B1 * | 12/2009 | Traykov | A61G 7/1096 | 5/81.1 R |
| 7,832,807 | B2 * | 11/2010 | Shickle | A61G 5/10 | 297/466 |

(Continued)

*Primary Examiner* — Shin H Kim

(74) *Attorney, Agent, or Firm* — Rathe Lindenbaum LLP

(57) ABSTRACT

A travel leg restraint may include a single elongate member. The single elongate member may include a first upwardly facing concave contour about a first axis and dimensioned to receive a first leg of a user, a second upwardly facing concave contour about a second axis and dimensioned to receive a second leg of a user and a spacing wall between the first concave contour and the second concave contour so as to extend between the first leg and the second leg of the user. The travel leg restraint may further include at least one top strap secured to opposite ends of the elongate member to extend across and span the first concave contour and the second concave contour, wherein the strap has an adjustable length.

20 Claims, 5 Drawing Sheets

(56) References Cited

U.S. PATENT DOCUMENTS

| | | | | |
|---|---|---|---|---|
| 8,156,941 | B1 * | 4/2012 | Simms | A47C 20/021 128/845 |
| 9,044,097 | B1 * | 6/2015 | Ardrey | A47C 7/52 |
| 2001/0027577 | A1 * | 10/2001 | Frydman | A47C 20/021 5/648 |
| 2010/0095452 | A1 * | 4/2010 | Traykov | A61G 7/1038 5/81.1 R |
| 2011/0094028 | A1 * | 4/2011 | Traykov | A61G 7/1038 5/83.1 |
| 2011/0179577 | A1 * | 7/2011 | Gould | A61G 5/12 5/648 |
| 2012/0180219 | A1 * | 7/2012 | Riccabona | A47C 20/021 5/636 |
| 2017/0120784 | A1 * | 5/2017 | Barron | B60N 2/7005 |
| 2018/0008064 | A1 * | 1/2018 | DuDonis | A47G 9/0253 |

* cited by examiner

TRAVEL LEG RESTRAINT

CROSS-REFERENCE TO RELATED PATENT APPLICATIONS

The present non-provisional application claims priority under 35 USC 119 from co-pending U.S. Provisional Patent Application Ser. No. 62/336,001 filed on May 13, 2016 by Matthew J. Behlen and entitled TRAVEL LEG RESTRAINT, the full disclosure of which is hereby incorporated by reference.

BACKGROUND

During travel, passengers frequently sleep. During such sleep, the legs of the passenger may have a natural tendency to pivot outwardly. Such outward movement of the passenger's legs may result in the passenger's legs undesirably contacting an adjacent passenger.

DETAILED DESCRIPTION OF EXAMPLES

Figure 1:
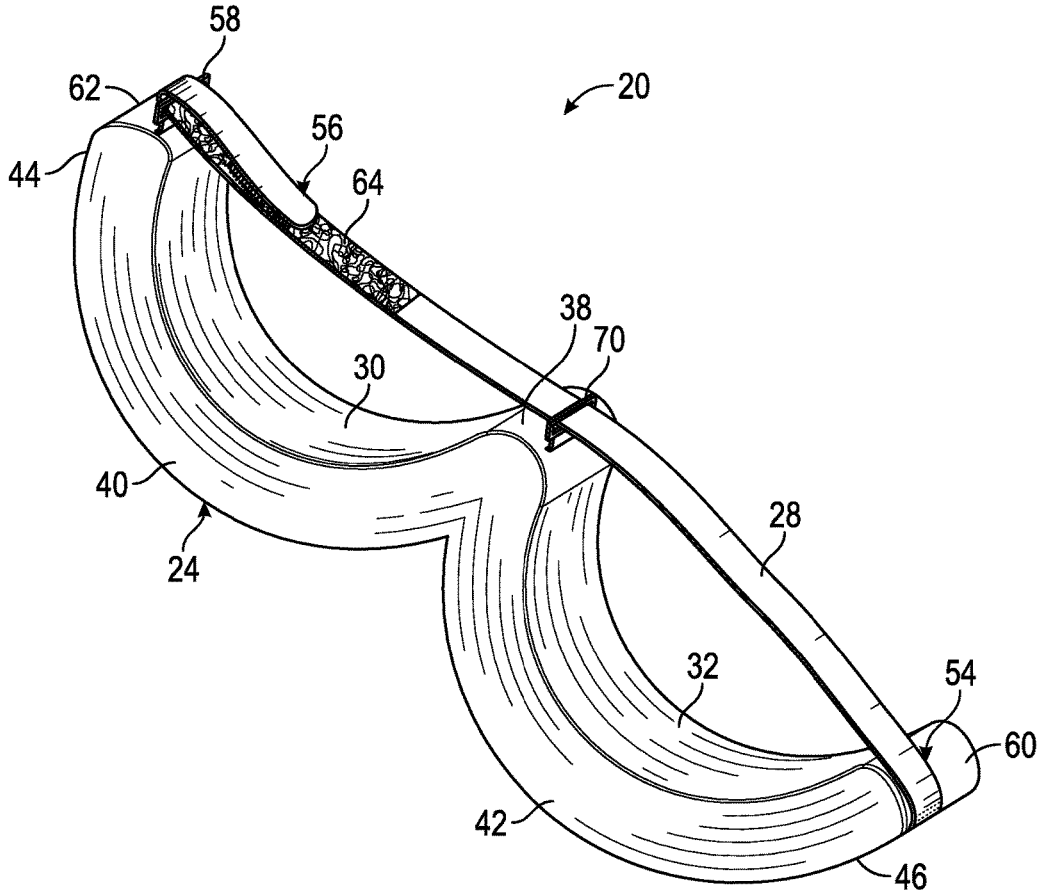
FIG. 1 the top perspective view of an example travel leg restraint.

FIG. 1 is a perspective view of an example travel leg restraint 20 that may be worn by a passenger to restrain his or her legs during travel. Travel leg restraint 20 cradles both legs and retains both legs relative to one another. Travel leg restraint 20 comprises a single elongate member 24 and at least one top strap 28.

Member 24 comprises a structure which forms two cradles or two upwardly facing concave surfaces or contours 30, 32. Contours 30, 32 are concave and are sized to underlie and receive bottom surface or portions of the thighs of a person or passenger, just above the knees of the passenger. In the example illustrated, each of contours 30, 32 has a partial curved, semicircular circular or semi oval cross sectional shape. In other implementations, each of contours 30, 32 may have a polygonal cross sectional shape, such as a hexagonal or octagonal cross sectional shape. In one implementation, each of contours 30, 32 has a radius of at least 3 inches for children and at least 4 inches for adults.

In the example illustrated, member 24 has the shape of a W. In the example illustrated, member 24 comprises a spacer wall 38, bottom walls 40, 42 and sidewalls 44, 46. Spacer wall 38 extends between contours 30, 32 and forms inner sides of contours 30 and 32. Bottom walls 40 and 42 extend outwardly from spacer wall 38 and form the underside of each of contours 30 and 32. Sidewalls 44 and 46 rise upwardly from bottom walls 40 and 42 to form the outer sides of contours 30 and 32, respectively. In the example illustrated, bottom walls 40, 42 curve upwardly to form sidewalls 44 and 46, respectively, lacking sharp corners at the junctures with sidewalls 44 and 46. In the example illustrated, member 24 additionally comprises a recess 50 between bottom walls 40 and 42. Recess 50 provides airflow and ventilation while facilitating pivoting or bending of bottom walls 40, 42 and sidewalls 44, 46.

In one implementation, member 24 is formed from a single elongate piece of foam, such as memory foam. In one implementation, member 24 is covered with a breathable and soft fabric that overlies the foam. In one implementation, the fabric layer forms a case over and about the inner core formed from foam. In one implementation, the fabric layer is closed about the core foam with a zipper, button or hook and loop (VELCRO) securement mechanism, facilitating separation and removal of the outer case from the inner foam core to facilitate repair, replacement or cleaning of the outer case.

In yet another implementation, member 24 comprises at least one inflatable chamber. In one implementation, member 24 comprises at least one inflatable chamber configured to be filled with a gas, such as air. In one implementation, member 24 comprises at least one inflatable chamber configured to be filled with a liquid, such as water. In such implementations, member 24 facilitates passenger customized filling of the one or more chambers to different pressure levels per the passenger's individual preferences. In yet other implementations, member 24 comprises at least one chamber which is filled with a particulate material, such as particles or beads of compressible or incompressible materials, such as those materials found in beanie babies.

In one implementation, member 24 has a uniform degree of flexibility or stretchability throughout. In yet other implementations, member 24 has different degrees of flexibility and/or stretchability in selected portions. Stretchability refers to the ability of a portion to be elongated are stretched in response to a given amount of force. Such stretchability may be provided due to dimensioning or may be provided due to material composition. For example, a foam material forming member 24 may have a greater thicknesses in some regions to provide less stretchability as compared to other thinner regions. Portions of member 24 maybe formed from a first foam composition while other portions maybe formed from a second different foam composition, wherein the first foam composition has a greater degree of stretchability as compared to the second foam composition. In some implementations different portions of the casing about foam material or core med different degrees of stretchability or flexibility. For example, the casing may have a first portion formed from a first material having a first degree of resilient stretchability and may have a second portion formed from a second different material having a second different, lesser or greater degree of resilient stretchability. Likewise, in cases where member 24 is formed by one or more filled chambers. Different chambers may be filled with different material or to different extents to provide different degrees of stretchability. In addition, or alternatively, the walls forming the chambers may vary in composition, wherein some walls have greater degrees of stretchability as compared to other walls.

Top strap 28 comprises an elongate flexible band of material secured to opposite ends of member 24 so as to extend across and span concave contours 30 and 32. In the example illustrated, strap 28 has an adjustable length. In one implementation, strap 28 is elastic to provide an adjustable length. In another implementation, strap 28 may employ a buckle or other similar mechanism to adjust the length of strap 28 extending between the opposite ends of member 24.

In the example illustrated, strap 28 has a first end 54 secured to a top of sidewalls 46 by stitching, welding or other securement mechanisms. Strap 28 has a second end 56 that is looped through a loop 58. In one implementation loop 58 comprises a buckle to secure and adjust the length of strap 28 extend between connection points 60 and 62. In other implementations, loop 58 comprises a simple loop, wherein end 56 is retained and secured in place by other mechanisms. In the example illustrated, and 56 of strap 28 is secured and retained in place by a hook and loop fastening mechanism 64, wherein hooks are provided on a first portion of strap 28 while corresponding engaging loops are formed on a second portion strap 28. As a result, a passenger may grasp end 56 and pull end 56 through loop 58 to retain sidewalls 44 and 46 in proximity to spacer wall 38, inhibiting the received legs from accidentally pivoting outward into contact with an adjacent passenger.

In the example illustrated, restraint 20 additionally comprises loop 70. Loop 70 is formed as part of or is connected to spacer wall 38 on a top side of member 24. Strap 28 extends through loop 70. Loop 70 guides and retain strap 28 across and over top of member 24 such that the length of strap 28 spanning between connection points 60 and 62 does not inadvertently change. Strap 70 further assists in pulling spacer wall 38 upwardly (or preventing spacer wall 38 from being pulled downwards) such that the two legs received within the cradles provided by contours 30 and 32 remain comfortably spaced or separated from one another.

Figure 2A:
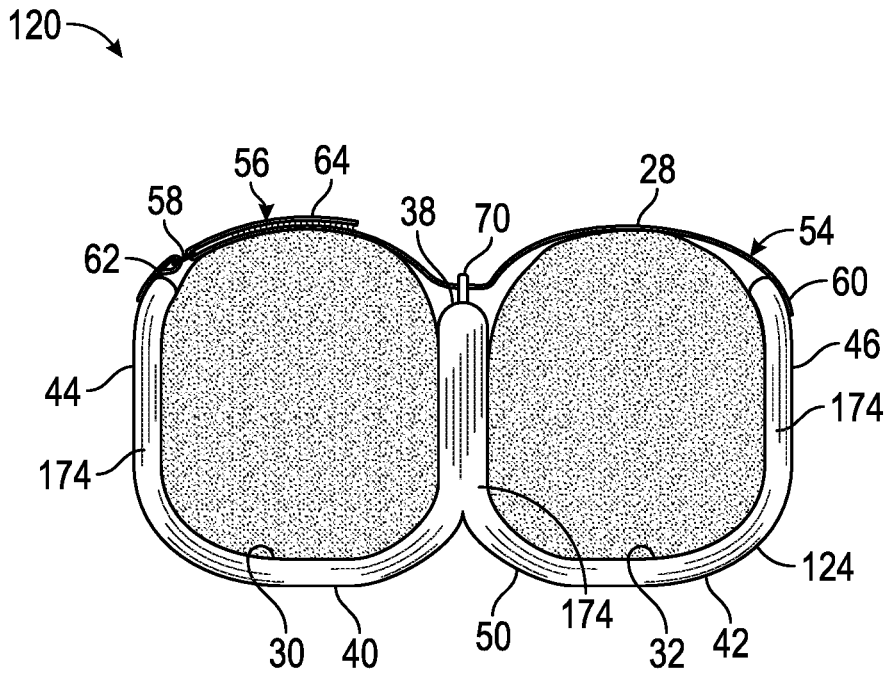
FIG. 2A is a sectional view of another example travel leg restraint used by first example person.
Figure 2B:
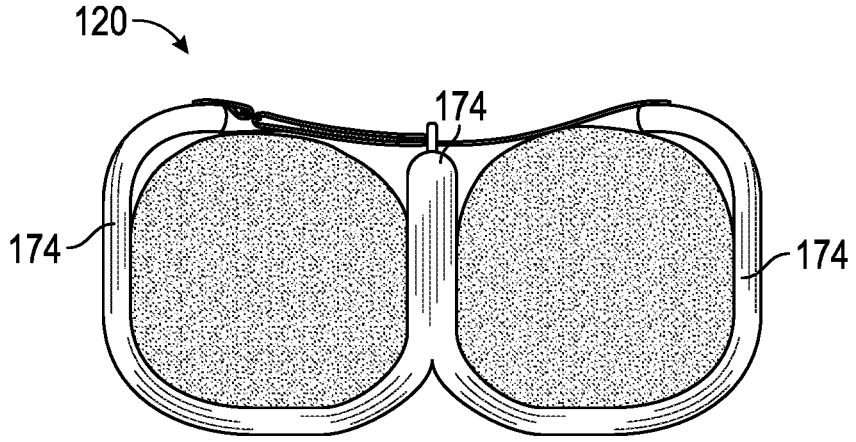
FIG. 2B is a sectional view of the example travel leg restraint of FIG. 2A used by a second example person.

FIGS. 2A and 2B are sectional views illustrating another example travel leg restraint 120 receiving legs of a passenger. Leg restraint 120 is similar to leg restraint 20 described above except that restraint 120 comprises a single elongate member 14 in lieu of member 24. Member 14 is similar to member 24 except that member 14 is illustrated as having a smaller recess and as having stretch zones 174 (shown in darker shaded regions. Those remaining components or elements of member 124 and of restraint 120 which correspond to components or elements of member 24 and restraint 20 are numbered similarly.

As shown by the darker shaded regions of the Figures, stretch zones 174 extend across and within divider or spacer wall 38 and sidewalls 44, 46. Stretch zones 174 comprise regions having higher degrees of stretchability as compared to portions of member 14 that do not have such stretch zones. Stretchability refers to the ability of a member structure to resiliently elongate in shape without permanent structural damage or permanent alteration of the structure, in response to a given amount of stretching force, and then return to the initial length and shape upon removal of the stretching force. In the example illustrated, bottom walls 40 and 42 omit stretch zones 174.

FIG. 2A illustrates restraint 120 worn by a larger passenger, such as an adult, while FIG. 2B illustrates restraint 120 worn by a smaller passenger, such as a child. As shown by FIG. 2A, stretch zones 174 facilitate stretching of sidewalls 44, 46 and spacer wall 38 to accommodate the larger passenger. At the same time, the resilient nature of such stretch zones allows member 24 to resiliently return to its initial original shape and size for use with a smaller passenger. As further shown by FIG. 2B, sidewalls 44, 46 are flexible so that they may partially wrap around the smaller legs of the smaller passenger. In one implementation, sidewalls 44, 46 are limited in height so as to not completely wrap over top of the smaller passengers legs, leaving upper surfaces of the person's legs or thighs exposed for ventilation.

In one implementation, stretch zones 174 are created by forming sidewalls 44, 46 and spacer wall 38 from a material composition that is more resiliently stretchable as compared to the material composition of other portions of member 124. For example, in some implementations, the entire thickness of sidewalls 44, 46 and spacer wall 38 may be formed from more resulting stretchable material composition. In another implementation, the entirety of member 14 may have a core is formed from the same material composition which offers a high degree of resilient stretchability, wherein stretch zones 174 are formed by one or more outer cover layers, such as an elastic fabric, which are more stretchable as compared to the outer cover layers that extend over those portions of member 124 which omit stretch zones 174. In some implementations, not each of sidewalls 44, 46 and 38 may be provided with stretch zones 174. In some implementations, the extent of such as zones 174 may be different than that illustrated.

Figure 3A:
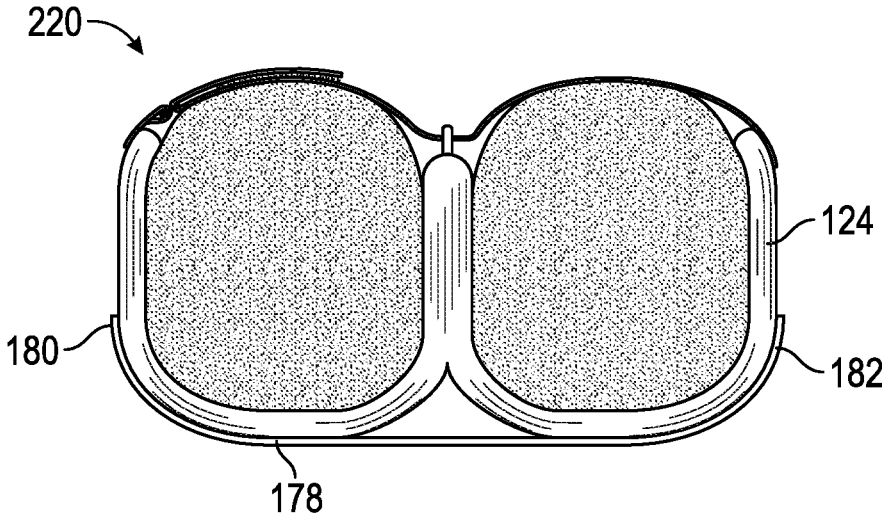
FIG. 3A is a sectional view of another example travel leg restraint used by first example person.
Figure 3B:
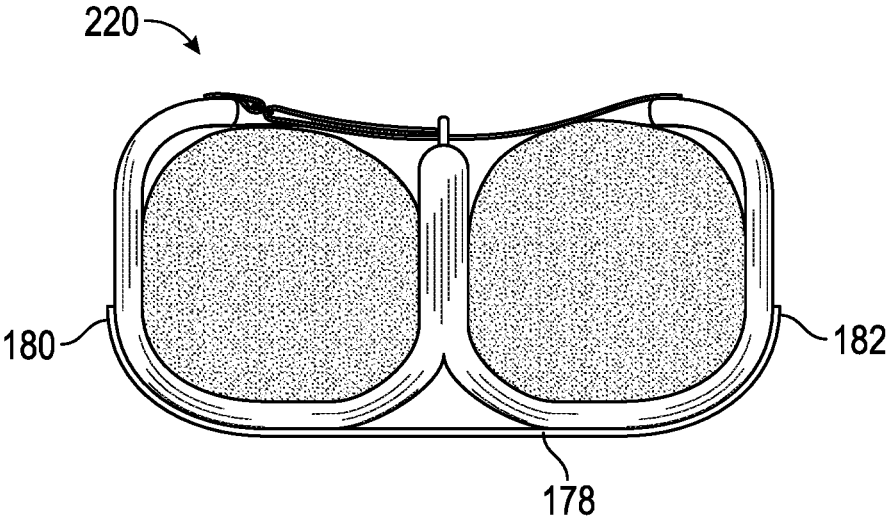
FIG. 3B is a sectional view of the example travel leg restraint of FIG. 3A used by a second example person.

FIGS. 3A and 3B are sectional views illustrating another example travel leg restraint 220 worn by differently sized passengers. Restraint 220 is similar to restraint 120 described above except that restraint 220 additionally comprises bottom strap 178. Those remaining components of restraint 220 which correspond to components of restraint 120 or restraint 20 are numbered similarly.

Bottom strap 178 comprises an elongate inflexible band of material secured to and extending across the bottom of restraint 220. In the example illustrated, bottom strap 178 has a first end portion 180 affixed (such as by stitching, welding, adhesive or the like) to member 124 proximate the junction of bottom wall 40 and sidewalls 44. Bottom strap 178 has a second end portion 182 affixed (such as by stitching, welding, adhesive or the like) to member 124 proximate the junction of bottom wall 42 and sidewall 46. In one implementation, the span of material forming bottom 178 between and portions 180 and 182 is not adhered or fixed to anything. In another implementation, the same span of material is affixed to the underside of bottom walls 40 and 42. Bottom strap 178 is a lower degree of flexibility or substantially no flexibility as compared to stretch zones 174. Bottom strap 178 restricts or inhibits the stretching of bottom walls 40 and 42. For purposes of this disclosure, a "strap" refers to a band of material having a thickness of no greater than 0.25 inches. In contrast, members 24 and 14 are not straps. In one implementation, each of members 24 and 14 have a thickness of at least 0.5 inches and in some instances, a thickness of at least 1 inch.

Figure 4A:
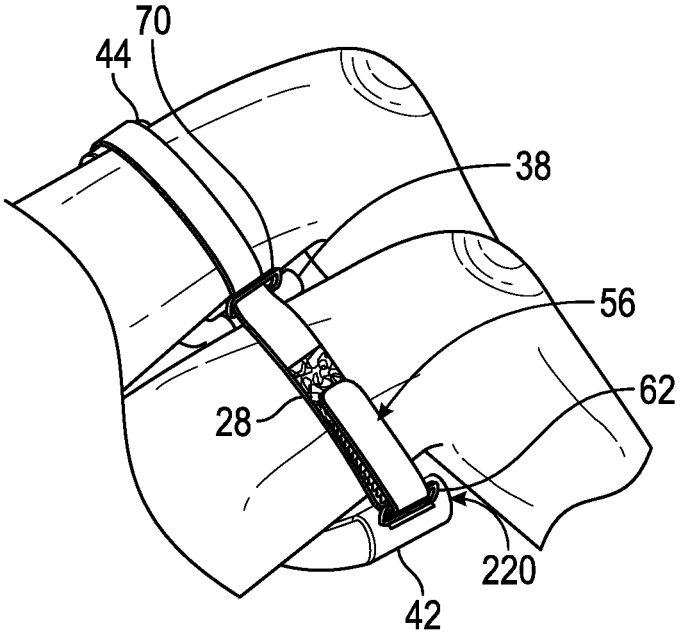
FIG. 4A is a fragmentary top view of the example travel leg restraint of FIG. 3A used by the first example person.
Figure 4B:
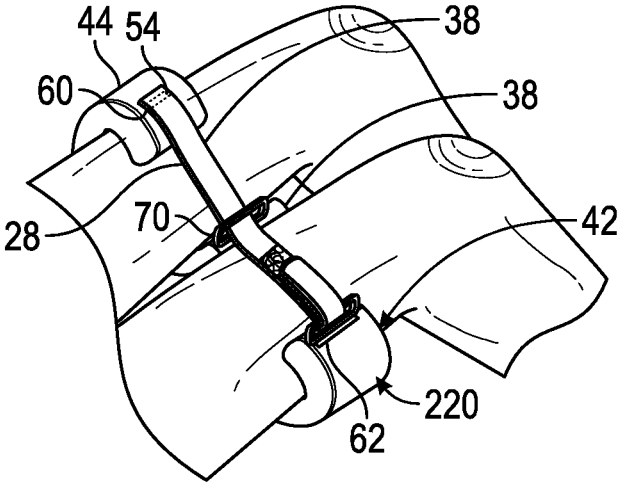
FIG. 4B is a fragmentary top view of the example travel leg restraint of FIG. 3B used by the second example person.

FIGS. 4A and 4B illustrate travel leg restraint 120 worn by the differently sized passengers. Leg restraints 20 and 120 may be worn by different sized passengers in a similar fashion. As shown by such Figures, a passenger or person positions his or her legs within and against concave cavities 30, 32 with spacer wall 38 extending between the person's legs, just above the person's knees. The person then pulls strap 28 through loops 70 and through loops 62 is needed depending upon the person's size. And 56 of strap 28 is then secured in place at the selected length, such as where loops 62 comprise the buckle or in implementations where end portion 56 is secured to remaining portions of strap 28 other securing mechanisms such as hook and loop fasteners, snaps, buttons or the like.

Figure 5:
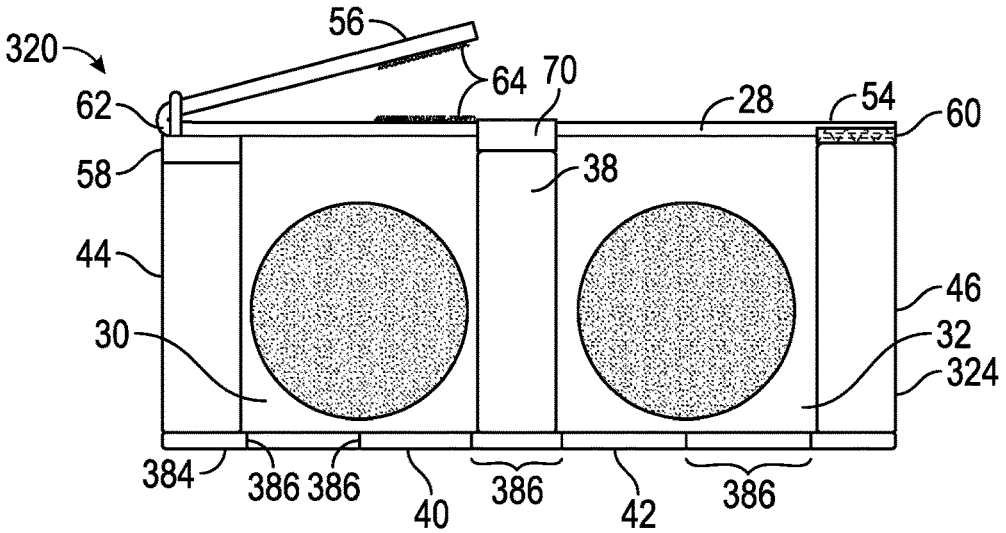
FIG. 5 is a sectional view of another example travel leg restraint being worn by an example person.

FIG. 5 is a sectional view of another example travel leg restraint 320. Restraint 320 is similar to restraints 20, 120 and 220 except that restraint 320 is configured to be collapsible to facilitate storage and packing for travel. Restraint 320 is similar to restraint 120 described above except that restraint 320 comprises member 324 in place of member 124. Member 324 itself is similar to member 14 except that member 324 comprises a bottom panel 384 interconnecting sidewalls 44, 46 and spacer wall 38. Those remaining components of restraint 320 are numbered similarly.

Bottom panel 384 comprises a thin panel affixed or joined to each of sidewalls 44, 46 and spacer wall 38. Bottom panel 384 is substantially inflexible and rigid. Bottom panel 34 comprises hinges 386. In one implementation, hinges 386 may comprise perforated lines or fold lines. In another implementation hinges 36 may comprise small bridges a flexible material, such as a fabric or polymer, spanning between and flexibly connecting the rigid portions of panel 384. In other implementations hinges 386 may comprise a mechanical hinges or other structures that facilitating bending or folding of panel 384.

Figure 6:
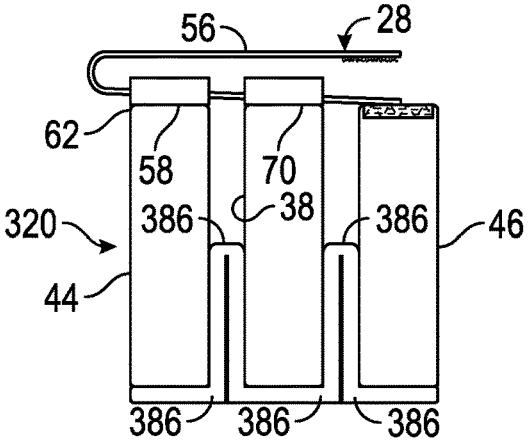
FIG. 6 is a sectional view of the example travel leg restraint of FIG. 5 in a collapsed state.

As shown by FIG. 5, when unfolded, panel 34 forms bottom walls 40 and 42, wherein bottom walls 40 and 42 are substantially inflexible and un-stretchable. In one implementation, spacer wall 38 and sidewalls 44, 46 comprise stretch zones 174 described above. As shown by FIG. 6, when restraint 320 is not being utilized, sidewalls 44 and 46 may be collapsed towards spacer wall 38, whereas panel 384 pivots about hinges 386 and folds between sidewall 44 and 38 and between spacer 38 and sidewall 46. At the same time, strap 28 may be pulled completely through loops 70 and 58 as needed. The resulting collapsed restraint 320 shown in FIG. 6 is more compact for storage and transportation, such as during a trip when not being utilized.

Figure 7:
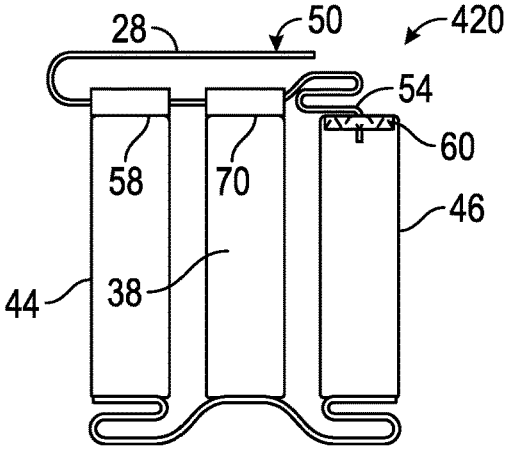
FIG. 7 is a sectional view of another example travel leg restraint in a collapsed state.

FIG. 7 is a sectional view illustrating travel leg restraint 420. Restraint 420 similar to restraints 320 described above except that restraints 420 comprises panel 484 in place of panel 384. Panel 484 comprises a panel of flexible, but un-stretchable material. In one implementation, panel 484 comprises a panel of un-stretchable fabric. In another implementation, panel 484 comprises a panel of other flexible, but unstretchable material such as leather, a synthetic leather or a polymer. In one implementation, panel 484 comprises a panel of a mesh material or a latticework, providing enhanced ventilation or breathability. As shown by FIG. 7, panel 484, like panel 384, facilitates the collapse of sidewalls 44 and 46 towards spacer wall 38. In the example illustrated, panel 44 may be folded upon itself during such collapse. Although each of sidewalls 44 and 46 and 38 are illustrated as having sharp corners at the junction with panel 384 and 484 one forming concave contours 30, 32, in other implementations, such corners may be rounded or curved with the concave side facing the legs.

Figure 8:
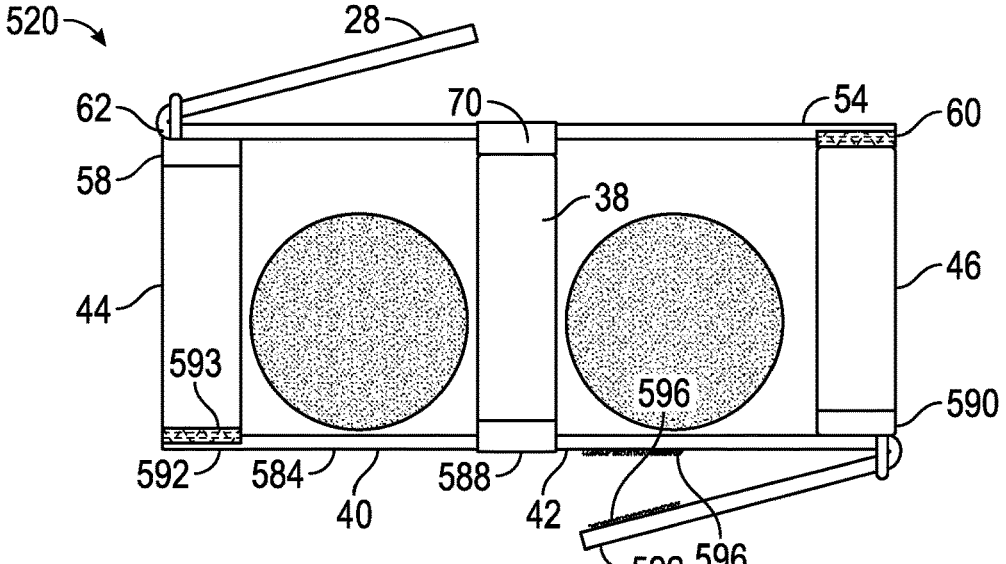
FIG. 8 is a sectional view of another example travel leg restraint worn by an example person.

FIG. 8 is a sectional view of travel leg restraint 520, another example implementation of restraint 20. Restraint 520 is similar to restraint 420 described above except that restraints 520 comprises bottom strap 584, loop 588 and loop 590 in lieu of panel 484. Those remaining components of restraint 520 which correspond to components of restraint 420 or any of the other above-described restraints are numbered similarly.

Bottom strap 584 comprises an elongate band of material having a first end portion 592 affixed to sidewall 46 (such as by the illustrated stitching 593 or by welds, adhesives or the like). In some implementations, bottom strap 584 may be integrally formed with an outer covering of sidewall 44. Bottom strap 584 passes through loops 588 and through loop 590. Bottom strap 584 has an adjustable length. In one implementation, strap 584 is formed from a substantially unstretchable of material such that provided bottom walls 40 and 42 do not stretch when restraint 520 is being utilized. For purposes of this disclosure, "substantially unstretchable" refers to a material that stretches less than or equal to 5% without permanent structural damage to the material. In other implementations, bottom strap 584 may be formed from a stretchable or elastic material.

Loop 588 is similar to loops 70. Loop 588 extends along a bottom side of spacer wall 38. Loop number 588 guides and retain bottom strap 584 across and beneath spacer wall 38 such that the length of bottom strap 584 spanning between connection points 60 and 62 does not inadvertently change. Strap 584 further assists in pulling spacer wall 38 downwardly, wherein spacer wall 30 may be stretched upwardly such that the two legs received within the cradles provided by contours 30 and 32 remain comfortably spaced or separated from one another.

Loop 590 is similar to loop 58 described above. Loop 590 secured to a bottom side of sidewall 46. In other implementations, loop 590 may be secured to the bottom side of sidewall 44, whereas and portion 592 is affixed to the bottom of sidewall 46. In other implementations, in lieu of portions of strap 584 and loop 590 being secured to the bottom side of sidewalls 44, 46, portion strap 584 loop 590 may alternatively be secured to the sides of sidewalls 44 and 46, proximate to a bottom of sidewalls 44, 46.

In one implementation loop 590 comprises a buckle to secure and adjust the length of strap 584. In other implementations, loop 590 comprises a simple loop, wherein end 592 is retained and secured in place by other mechanisms. In the example illustrated, and 56 of strap 28 is secured and retained in place by a hook and loop fastening mechanism 596, wherein hooks are provided on a first portion of strap 584 while corresponding engaging loops are formed on a second portion strap 584. As a result, a passenger may grasp end 592 and pull end 592 through loop 590 to position sidewalls 44 and 46 in closer proximity to spacer wall 38, such that the legs are more snuggly received.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements.

What is claimed is:

1. A travel leg restraint comprising:

a single elongate member comprising:

a first upwardly facing concave contour about a first axis and dimensioned to receive a first leg of a user;

a second upwardly facing concave contour about a second axis and dimensioned to receive a second leg of a user; and a spacing wall between the first concave contour and the second concave contour so as to extend between the first leg and the second leg of the user; and at least one top strap secured to opposite ends of the elongate member to extend across and span the first concave contour and the second concave contour, the strap having an adjustable length, wherein the at least one top strap comprises a single strap and wherein the at least one connector comprises a loop member secured to the spacing wall and through which the at least one top strap extends.

2. The travel leg restraint of claim 1 further comprising at least one connector connecting the at least one top strap directly to the spacing wall between the first concave contour and the second concave contour.

3. The travel leg restraint of claim 1, wherein the elongate body comprises a bendable foam.

4. The travel leg restraint of claim 1, wherein the at least one top strap comprises a hook and loop fastener to facilitate adjustment of the length of the strap.

5. The travel leg restraint of claim 1, wherein the single elongate member has a bottom surface that is W-shaped.

6. The travel leg restraint of claim 1, wherein the single elongate member has a thickness of at least 1 inch and wherein the at least one strap has a thickness of no greater than 0.25 inches.

7. A travel leg restraint comprising:

a single elongate member comprising:

a first upwardly facing concave contour about a first axis and dimensioned to receive a first leg of a user;

a second upwardly facing concave contour about a second axis and dimensioned to receive a second leg of a user; and a spacing wall between the first concave contour and the second concave contour so as to extend between the first leg and the second leg of the user; and at least one top strap secured to opposite ends of the elongate member to extend across and span the first concave contour and the second concave contour, the strap having an adjustable length;

a first bottom wall, a second bottom wall, a first side wall and a second side wall, wherein the first bottom wall extends between and connects the spacing wall and the first side wall to form the first concave contour, wherein the second bottom wall extends between and connects the spacing wall and the second side wall to form the second concave contour.

8. The travel leg restraint of claim 7 comprising a recess underlying the spacing wall.

9. The travel leg restraint of claim 7, wherein the spacing wall has a first degree of stretchability and wherein the first bottom wall and the second bottom wall have a second degree of stretchability less than the first degree of stretchability.

10. The travel leg restraint of claim 9, wherein the spacing wall has a first material composition and wherein the first bottom wall and the second bottom wall have a second material composition different than the first material composition.

11. The travel leg restraint of claim 9 further comprising a bottom strap secured to the single elongate member proximate the first bottom wall and the second bottom wall, the bottom strap extending across and beneath the first bottom wall, the spacing wall and the second bottom wall to restrict stretching of the first bottom wall and the second bottom wall.

12. The travel leg restraint of claim 7, wherein the spacing wall, the first side wall and the second side wall each have a first degree of stretchability and wherein the first bottom wall and the second bottom wall have a second degree of stretchability less than the first degree of stretchability.

13. The travel leg restraint of claim 12, wherein the spacing wall, the first side wall and the second sidewall each have a first material composition and wherein the first bottom wall and the second bottom wall have a second material composition different than the first material composition.

14. The travel leg restraint of claim 12 further comprising a bottom strap secured to the single elongate member proximate the first bottom wall and the second bottom wall, the second strap extending across and beneath the first bottom wall, the spacing wall and the second bottom wall to restrict stretching of the first bottom wall and the second bottom wall.

15. The travel leg restraint of claim 1 further comprising a bottom strap having opposite ends secured to opposite sides of the single elongate member, the bottom strap continuously extending beneath the first concave contour and the second concave contour.

16. A travel leg restraint comprising:

a first side wall;

a second sidewall;

a spacer wall between the first side wall and the second sidewall;

a collapsible bottom panel connected to the first side wall, the second sidewall and the spacer wall; and at least one top strap secured to the first side wall and the second sidewall to extend across and span a first leg receiving cavity between the first side wall and the spacer wall and a second leg receiving cavity between the second sidewall and the spacer wall, the strap having an adjustable length.

17. A travel leg restraint comprising:

a first side wall;

a second sidewall;

a spacer wall between the first side wall and the second sidewall;

a bottom strap connected to the first side wall, the second sidewall and the spacer wall; and at least one top strap secured to the first side wall and the second sidewall to extend across and span a first leg receiving cavity between the first side wall and the spacer wall and a second leg receiving cavity between the second sidewall and the spacer wall, the strap having an adjustable length.

18. The travel leg restraint of claim 17, wherein the bottom strap has an adjustable length.

19. The travel leg restraint of claim 17, wherein the bottom strap is substantially unstretchable.

20. The travel leg restraint of claim 7, wherein the elongate body comprises a bendable foam.

* * * * *